United States Patent [19]

Chaput et al.

[11] 4,424,419

[45] Jan. 3, 1984

[54] ELECTRET MICROPHONE SHIELD

[75] Inventors: Guy J. Chaput, Carleton Place; Edward M. Sich, Nepean; Beverley W. T. Gumb, London, all of Canada

[73] Assignee: Northern Telecom Limited, Montreal, Canada

[21] Appl. No.: 312,375

[22] Filed: Oct. 19, 1981

[51] Int. Cl.[3] ..... H04R 19/04

[52] U.S. Cl. ..... 179/111 E; 179/184; 179/187; 179/188; 307/400

[58] Field of Search ..... 179/111 E, 115.5 SF, 179/111 R, 181 R, 184, 187, 188; 174/102 R, 121 R, 126 CP, 130, 117 FF, 133 R, 35 MS, 35 R; 307/400; 219/10.55 D

[56] References Cited

U.S. PATENT DOCUMENTS 3,944,756 3/1976 Lininger ..... 179/111 E
4,046,974 10/1976 Baumhauer et al. ..... 179/111 R

FOREIGN PATENT DOCUMENTS 1259774 1/1972 United Kingdom ..... 174/35 MS

OTHER PUBLICATIONS

*Journal of Microwave Power*, vol. 5, No. 3, 1970, Dan R. McConnell et al., "A Dielectric Filled Inserted Choke Seal for the Microwave Oven", pp. 183–187.

*Primary Examiner*—G. Z. Rubinson
*Assistant Examiner*—Danita R. Byrd
*Attorney, Agent, or Firm*—Stuart L. Wilkinson

[57] ABSTRACT

An electret microphone has a metal shield around it in order to guard against electromagnetic interference. Acoustic waves reach the electret element through a passage in the shield. The electret response is undesirably affected by an electric field produced by body capacitance when the microphone is brought close to a user's mouth. To overcome this effect, the microphone has a conductive film, transparent to acoustic waves, positioned between the passage and the electret element, the film contacting a grounded part of the casing. The conductive film can form an integral part of a microphone moisture barrier.

9 Claims, 1 Drawing Figure

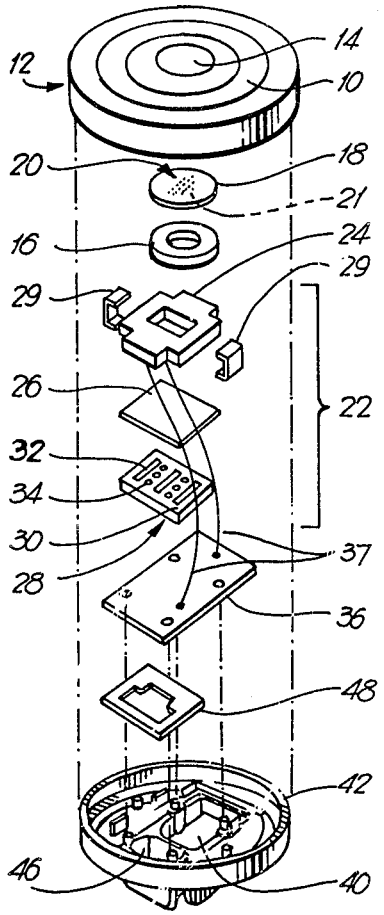
12
14
10
20
18
21
16
24
29
29
26
22
32
34
30
37
28
36
48
42
46
40

ELECTRET MICROPHONE SHIELD

This invention relates to electret microphones particularly for use in telephones.

Telephone electret microphones need to be shielded from electromagnetic interference to which the microphone is subjected in normal use. Such fields existing in the home, for example, are radiated from nearby television and radio transmitters and from electric motors. In a known telephone electret microphone design, the microphone components are surrounded by, and the electret element shielded by, an aluminum casing. One or more circular holes in the surface of the casing allows transmission of acoustic waves to the electret element. Unfortunately, as a telephone user brings his face towards the hole, the electret element is subjected to a distorted electric field due to body capacitance. Normally, the output from the electret element is taken to an amplifier and then to a balanced line, balanced line transmission being used to compensate for interference occurring in the transmission path. However, unbalance produced by a distorted field at the electret element will not be compensated and is seen as a component of the acoustic signal. Consequently, shielding of all interference at the microphone, including that produced by body capacitance, is necessary.

A known electret microphone used in a telephone consists of the following components. The top component, which, in use, is located nearest the speaker's mouth, is one part of a two-part aluminum casing. The casing has a hole through its center to allow passage of acoustic waves. Beneath this casing part is a moisture barrier which is normally a thin film of plastic material such as Mylar (Registered Trade Mark) which is pressed into sealing engagement with the top part of the casing. Below the moisture barrier and a compressible mounting ring for the moisture barrier, lies the electret element which, together with associated electrical components, seats within a second part of the aluminum casing.

By the invention, it is proposed that the thin, acoustically transparent moisture barrier be a conducting component and that said component be situated such that it electrically contacts the electret microphone casing or other grounded or fixed potential body.

Preferably the component comprises a substrate plastic film, the film having a conductive coating deposited thereon.

An embodiment of the invention will now be described by way of example with reference to the accompanying exploded view of an electret microphone.

Referring in detail to the drawing, the microphone illustrated has a top ferrule or casing part 10. The ferrule is made of aluminum. It has an upper ridge 12 which can engage an internal threaded part of a telephone handset housing (not shown). An upwardly pressed annular portion 14 accommodates and centers a sealing washer 16. On assembly, the sealing washer 16 presses a combined moisture barrier and shielding element 18 into the recessed portion 14. The element 18 has an upper conducting surface 20. The element is manufactured by vacuum-depositing a thin layer of aluminum onto a plastic film 21, such as Mylar of a thickness of 10 μm. The thickness and flexibility of the element 18 is such that it is rendered transparent to acoustic vibrations of between 10 Hz and 4 KHz. The sealing washer 16 acts to tension the element 18. If the element is improperly mounted, then there is a risk of its affecting the voice frequency vibration transmitted by it.

Below the flexible sealing washer 16 and tight against it is a transducer element 22. Basically the transducer element comprises a top frame 24 which clamps a piece of electret foil 26 against a bottom plate 28 by means of chips 29. The foil has a metallic top surface and a bottom layer which has the property of being able to store a charge for extended periods. The structure of the electret is well-known. The charge storage face is separated from a conducting layer 30 on the back plate 28 by strips, 50 microns thick, of dielectric film 32. The plate 28 in the region of the conducting layer is formed with holes 34 to permit the electret to vibrate in response to acoustic waves passing into the microphone. Because the charge stored in the bottom layer of the electret foil is invariable, then as it vibrates, the potential difference between the conducting layer 30 and the conducting surface of the electret varies to give an electric analog of the voice frequency vibration. By means of a printed conductor on board 36 which has wire leads 37 bonded to the electrical surfaces of the electret element 22, the varying electret voltage is taken to a field effect transistor (not shown) mounted on the reverse surface of the board. The field effect transistor projects into a chamber 40 which is formed in a bottom part 42 of the aluminum casing. The chamber size is chosen to optimize vibration of the electret foil 26. Contacts (not shown) are also formed on the reverse surface of the board 36 and communicate electrically with the circuit formed on the board upper face. The contacts project through a passage 46 in the casing part 42. A second seal 48 which surrounds the contacts 44 protects the inside of the microphone from adverse environmental conditions.

In use, the casing comprising ferrule 10 and bottom part 42 is grounded via one of the conductors on board 36, and so, consequently, is the top surface of the element 18. The element 18 thus functions to seal the microphone from moisture and gaseous contaminants and acts also to make the electromagnetic shield around the electret element complete. As previously indicated, the primary effect of this additional shielding part is in reducing the interference of that electric field produced by body capacitance which would otherwise affect the electret microphone output transmitted to a balanced line.

The combination of a plastic substrate and a thin deposited coating for the sealing element 18 is viewed as being an optimal but non-limiting construction. Thus the element 18 could, instead, be a single layer of conducting foil. However, it would be difficult to manufacture such a thin foil of, say, aluminum having the required transparency to voice frequency vibration, while retaining sufficient strength to mechanically protect the electret. Aluminum is particularly preferred as a conducting coating for the element 18 firstly, since it is easily vacuum-deposited on a plastic substrate, secondly, since the ferrule is also made of aluminum and therefore would not form an electric cell with the coating when damp, and lastly, since aluminum is a good conductor. However, it is appreciated that in other circumstances other conductors such as copper or zinc may be preferred, or the element may alternatively be composed of a carbon loaded plastic.

In the embodiment shown, the top surface of the element 18 is made conducting and that surface contacts the grounded ferrule 10. In other arrangements it may be preferred not to ground the casing around the electret in which case the conductive coating on the element 18 can be deposited on whichever surface of the element is made to contact a grounded or other fixed potential body.

In the embodiment described, the conductive coating extends over the full surface area of the element 18 so as to completely surround the transducer element 22 with an electromagnetic shield. However, in other circumstances, it may be preferred to limit the extent of the conducting coating on the element 18 to a central or marginal region vertically aligned with the central hole through the ferrule 10.

A conductive coating can be deposited on both sides of the element 18 in order to facilitate assembly.

What is claimed is:

1. In an electret microphone comprising a casing and an electret element within the casing for producing an electrical signal corresponding to acoustic vibration passing into the casing through a passage therein, the improvement comprising a conducting film blocking the passage, the conducting film transparent to said acoustic vibration and impermeable to moisture, the film electrically contacting a fixed potential body whereby to fix the potential of the conducting film.

2. An electret microphone as claimed in claim 1, in which the conducting film comprises a conducting layer deposited on a substrate.

3. An electret microphone as claimed in claim 2, in which the substrate is a film of flexible plastics.

4. An electret microphone as claimed in claim 3, in which the combination of the plastic substrate and the deposited conducting layer is moisture-impermeable.

5. An Electret microphone as claimed in claim 4, further comprising a sealing member pressing the combination of said substrate and the conducting layer into engagement with an inside surface of the casing.

6. An electret microphone as claimed in claim 1, in which the casing is conducting and is grounded, said conducting film electrically contacting an inner surface of the casing.

7. An electret microphone as claimed in claim 6, in which both the conducting film and the casing are made of aluminum.

8. An electret microphone as claimed in claim 1, in which the conducting film is composed of a conductor loaded plastic.

9. An electret microphone as claimed in claim 8, in which the conductor is carbon.

* * * * *